United States Patent [19]

Motomura et al.

[11] 4,026,604

[45] May 31, 1977

[54] GROUND EXCAVATING APPARATUS

[75] Inventors: Mitsuteru Motomura, Kamakura; Chiaki Kojima, Tokyo; Hiroshi Ohta, Chigasaki; Akira Nemoto, Tokyo, all of Japan

[73] Assignee: Kabushiki Kaisha Komatsu Seisakusho, Tokyo, Japan

[22] Filed: Sept. 24, 1975

[21] Appl. No.: 616,289

[30] Foreign Application Priority Data

Sept. 30, 1974 Japan ..... 49-111412
Sept. 30, 1974 Japan ..... 49-111413
Sept. 30, 1974 Japan ..... 49-111414

[52] U.S. Cl. ..... 299/64; 299/70
[51] Int. Cl.[2] ..... E21C 35/02
[58] Field of Search ..... 299/64, 65, 67, 69, 299/70, 71; 173/43, 52; 296/64

[56] References Cited

UNITED STATES PATENTS

| | | | |
|---|---|---|---|
| 2,164,753 | 7/1939 | Parker et al. | 299/64 |
| 2,983,496 | 5/1961 | Grant | 299/67 |
| 3,346,300 | 10/1967 | Grant | 173/52 X |
| 3,574,405 | 4/1971 | Shimada et al. | 299/64 |
| 3,586,113 | 6/1971 | Grant | 173/52 X |
| 3,612,609 | 10/1971 | Reuls | 299/67 |

FOREIGN PATENTS OR APPLICATIONS

| | | | |
|---|---|---|---|
| 1,479,337 | 3/1967 | France | 299/64 |
| 1,377,809 | 12/1974 | United Kingdom | 299/70 |

*Primary Examiner*—Ernest R. Purser
*Assistant Examiner*—Richard E. Favreau
*Attorney, Agent, or Firm*—Armstrong, Nikaido & Marmelstein

[57] ABSTRACT

Such a ground excavating apparatus that conducts excavation of a soft stratum by means of a bucket and employs an impact crusher for the excavation of such a hard stratum as a rock bed or the like is disclosed.

Introduced in the present application is a ground excavator of such a category that comprises a housing, a bucket boom properly set in place in the said housing in a manner of being capable of traveling forward and rearward, a bucket properly fitted in place on the front end section of the said bucket boom in a manner of being capable of inclining, and an impact crushing mechanism well capable of traveling forward and rearward by virtue of a hydraulic jack housed in the said bucket boom, and employs the said bucket and the said impact crushing mechanism in an alternate manner to best suit the nature of the ground to be excavated.

6 Claims, 9 Drawing Figures

GROUND EXCAVATING APPARATUS

BACKGROUND OF THE INVENTION

The present invention relates to such a ground excavating apparatus as is suitable for excavating the heterogeneous ground consisting of hard and soft stratums including a rock bed and gravel.

The excavating apparatuses so far designed and manufactured for the purpose of conducting building of a tunnel or excavation of the ground are multifarious and diversiform, and are roughly classified into those of the bucket type proving suitable for excavating the soft ground and those of the impact crusher type proving suitable for excavating the comparatively hard ground.

The bucket type is such a type that generally conducts excavation of the soft ground by the operation of a bucket fitted in place on the top section of a bucket boom, hence unsuitable at all for the excavation of the hard ground. Meanwhile, the impact crusher type, on the part thereof, is what is applied to building of a tunnel in an extensive manner, and this category of ground excavating apparatus is what is employed for conducting excavation by cutting and crushing the face is a continuous manner without employing gunpowder, unlike the case of a blasting process.

The tunnel excavators presently employed are roughly classified into those of the total section cutting system and those of the partial section cutting system. The tunnel excavators of the partial section cutting system are those hitherto employed for excavating a coal mine and specifically remodeled for the purpose of conducting excavation for building a tunnel. The tunnel excavator of the total section cutting system are generally those employed for conducting excavation to a circular section. Multifarious models of tunnel excavators of the impact crusher type have been developed thus far, and have such common characteristics that generally cause the cutter thereof to be revolved, and to be given proper impellant force as well, for the purpose of conducting proper cutting or crushing of a rock.

However, for all the fact that the said bucket type and the said impact crusher type prove to be effective and efficient enough, in case the ground is well stabilized with a soft stratum and a hard rock bed, respectively, excavation by the employment of only either one of the said types is still impracticable or inefficient in the case of a general excavation work, since therein exist a variety of stratums in a mixed form as a reality.

SUMMARY OF THE INVENTION

In the case of the present invention, disclosed is such a ground excavator having the said two types properly combined therefor, wherein excavation of the soft ground is conducted by the employment of a bucket, while excavation of the hard ground, such as a rock bed or the like, is conducted by the employment of an impact crusher, thus proving well applicable for the excavation of the heterogeneous ground consisting of a soft stratum and a hard stratum.

To put it otherwise, one purpose of the present invention rests with providing such a ground excavating apparatus as is well applicable for excavating the heterogeneous ground consisting of both hard and soft stratums, another purpose of the present invention rests with providing such a ground excavating apparatus of a new system, wherein the bucket-applied excavation type and the impact crusher-applied excavation type are properly combined into a single set of ground excavating apparatus, and still other purpose of the present invention rests with providing such a ground excavating apparatus as is well capable of selecting at liberty any angle of excavation from within the range specified for the impact crusher for excavating a hard stratum, and is superb in workability as well.

Other purposes, features and advantages of the ground excavating apparatus introduced in the present invention will be made apparent enough readily through the following detailed description of certain perferred embodiments thereof given in conjunction with the accompanying drawings.

DETAILED DESCRIPTION OF THE PREFERRED EMBODIMENTS

Figure 1:
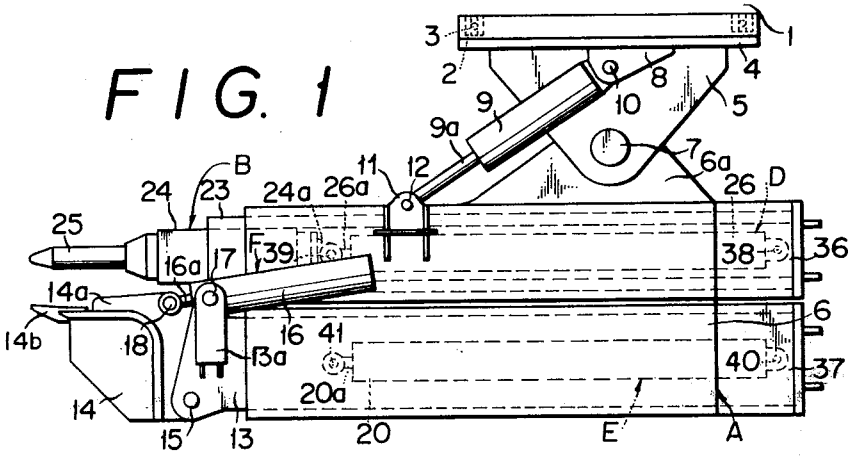
FIG. 1 is a side view of one illustration of the present invention.
Figure 3:
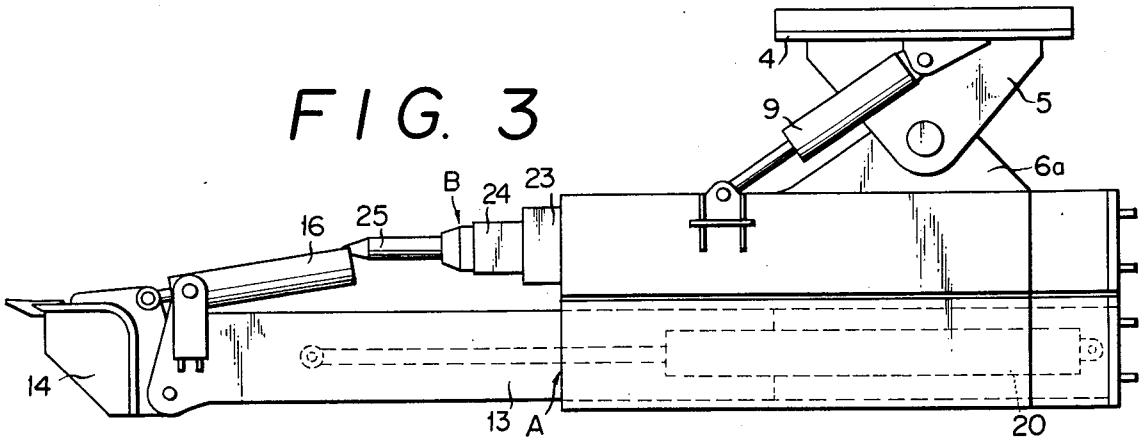
FIG. 3 and FIG. 4 are explanatory drawings of the actuation thereof.
Figure 2:
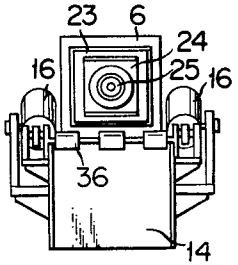
FIG. 2 is a front view of the illustration shown in FIG. 1.
Figure 4:
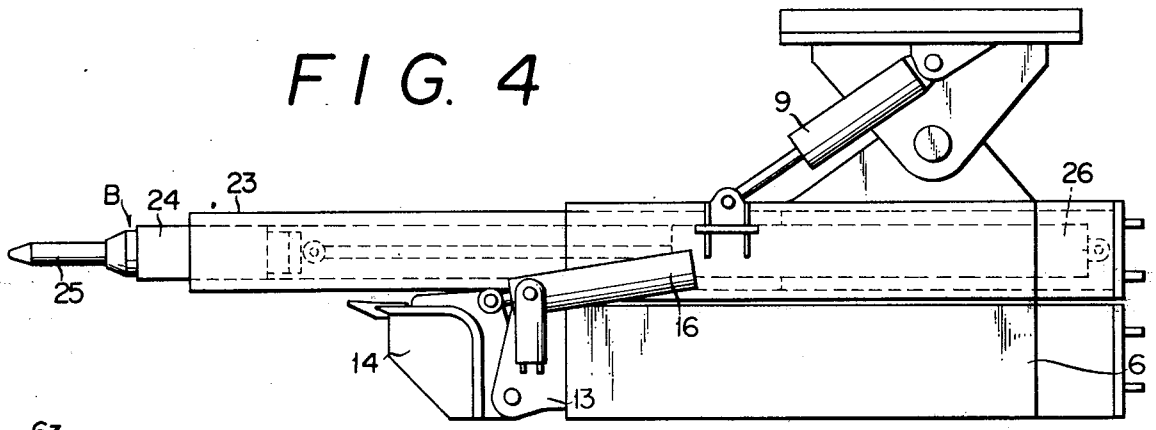
Figure 6:
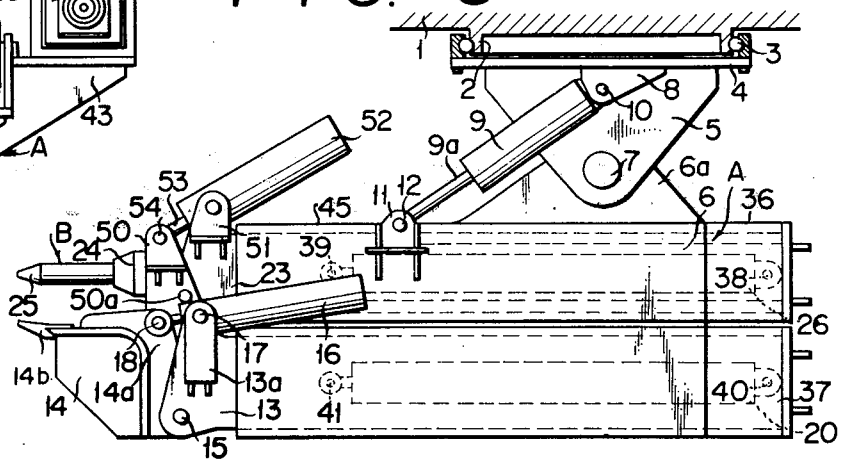
FIG. 6 is a side view of still other illustration of the present invention.
Figure 7:
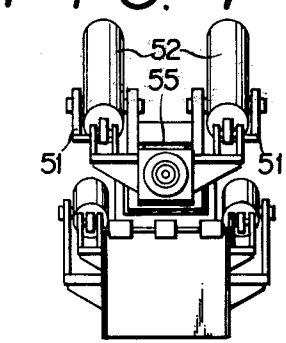
FIG. 7 is a front view of the illustration shown in FIG. 6.

In the drawings, 1 is a fixed member, and formed on the said fixed member 1 is a ring-shaped seat 2 for conducting proper fitting. The said ring-shaped seat 2 for conducting proper fitting has a swivel seat 4 properly set in place thereon through a pivoted bearing 3. The said swivel seat 4 has a bracket 5 properly fixed in place thereon. The said bracket 5 has a projecting section **6*a* of a housing 6 constituting a supporting member A properly fitted in place by means of a pin 7. The said swivel seat 4 has a bracket 8 properly fixed in place thereon, and the said bracket 8 has the base end section of a jack 9 for actuating a boom to face upward or downward properly fitted in place thereon. The said housing 6 has a bracket 11 properly set in place on the front upper section thereof, and the said bracket 11 has a rod 9*a* of the said jack 9 for actuating the boom to face upward or downward by the employment of a pin 12. The said housing 6 has an impact-crushing mechanism B fitted in place on the upper section thereof. The said impact-crushing mechanism B is provided with such a guide boom 23 as is properly fitted in place on the housing 6 in a manner of being capable of sliding in the forward and rearward directions, the said guide boom 23 has an impact-generating mechanism 24 properly fixed in place on the front end section thereof, and the said impact-generating mechanism 24 has a chisel 25** properly fitted in place on the movable side thereof.

The said guide boom 23 has an operating mechanism D, for instance, a sliding jack 26, properly set in place therein, and the base end section of the said sliding jack 26 is properly fitted in place on a jack support 36 by means of a pin 38. A rod **26*a* of the said sliding jack 26 is properly fitted in place on a bracket 24*a* fixed in place on the rear end section of the said impact-generating mechanism 24 by means of a pin 39. And, the said housing 6 has a bucket boom 13 properly set in place on the lower section thereof in a manner of being capable of traveling in the forward and rearward directions, the said bucket boom 13 has such a bracket 14***a* as is fixed in place on the back surface of a bucket 14 properly fitted in place on the front end section thereof, by means of a pin 15, the bucket boom 13 has a supporting bracket 13*a* properly fixed in place on the top end section thereof, the said supporting bracket 13*a* has such an inclination operation mechanism F as a bucket jack 16 properly fitted in place thereon by means of a pin 17, and a rod 16*a* of the said bucket jack 16 is properly fitted in place by means of a pin 18 on the said bracket 14*a* fixed in place on the back of the said bucket 14. The said bucket boom 13 has such an operating mechanism E as a sliding jack 20 properly set in place therein, the base end side of the said sliding jack 20 is properly fitted in place on a jack support 37 by means of a pin 40, and a rod 20*a* of the said sliding jack 20 is properly fitted in place on the said bucket boom 13 by means of a pin 41.

The said pivoted seat 4 is so designed as to be revolved by a revolution driving mechanism (not shown in the drawings).

Now, in the case of conducting excavation of a soft and weak stratum, the sliding jacks 20, 20 are actuated, the bucket boom 13 is thus caused to advance forward, the bucket 14 is caused to draw near to a proposed stratum, the bucket jack 16 is actuated in such a manner as to be subjected to rocking the bucket 14, and excavation of the stratum is conducted by means of such an excavating fluke 14*b* as is properly fitted in place on the said bucket 14.

Meanwhile, in the case of excavating a stratum consisting of a hard rock bed, the sliding jack 26 is extended for proper actuation, and the impact-generating mechanism 24 is caused to advance forward through the means of the said guide boom 23, thus causing the said chisel 25 to advance forward in a proper manner.

In this state, the said impact-generating mechanism 24 is put to proper actuation, and then impact-crushing of a proposed stratum is conducted by means of the said chisel.

The chips of the soft stratum thus excavated and/or the chips of the hard stratum thus crushed are raked together by means of the bucket 14. To put it otherwise, the said jack 9 for actuating the boom to face upward or downward is put in actuation in the state of having the bucket boom 13 properly extended, thus causing the bucket 14 to be transferred as far as to the position of the said excavated and/or crushed chips, the bucket jack 16 is actuated, the sliding jack 20 is extended and the bucket boom 13 is contracted in a concurrent manner, and the said jack 9 for actuating the boom to face upward or downward is also concurrently actuated, whereby raking the said excavated and/or crushed chips together by the employment of the said bucket 14 is thus properly conducted.

Figure 5:
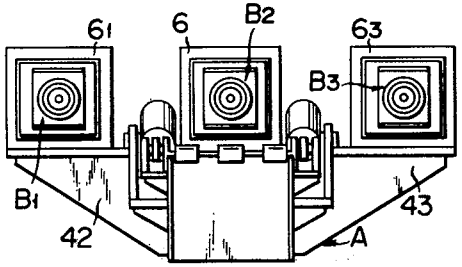
FIG. 5 is a front view of other illustration of the present invention.
Figure 8:
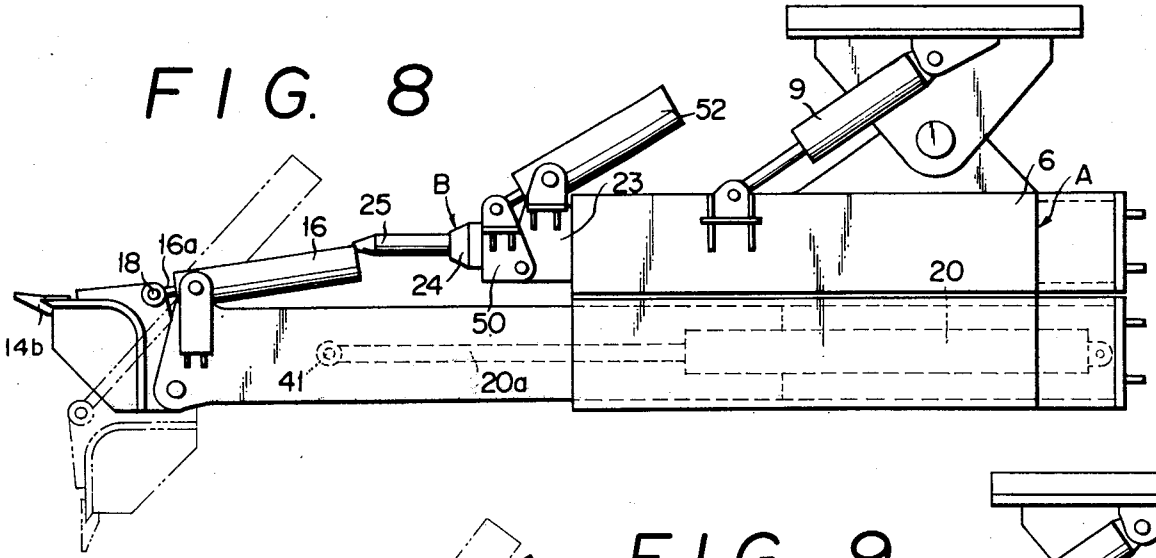
FIG. 8 and FIG. 9 are explanatory drawings of the actuation thereof.
Figure 9:
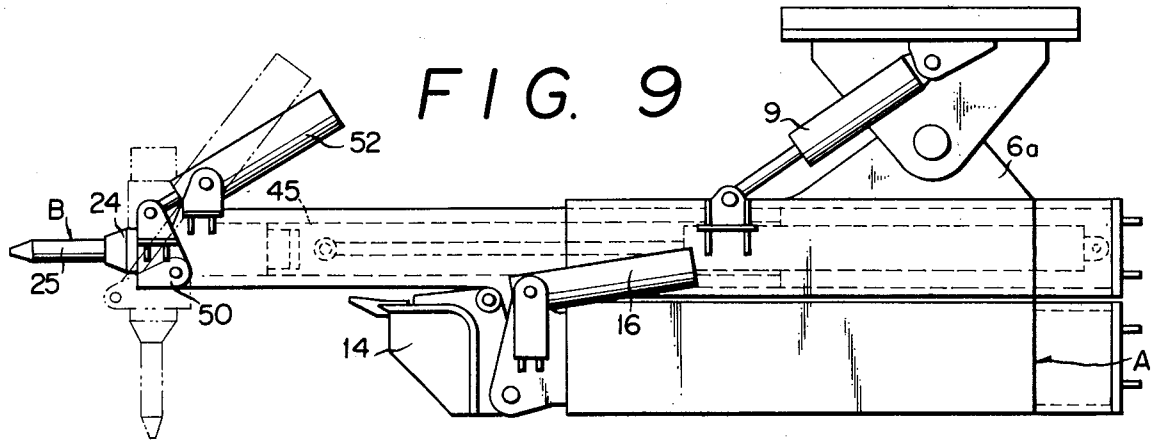

Next, shown in FIG. 5 is other illustration of the present invention, wherein a plurality of impact crushing mechanisms are properly fitted. To put it in concrete terms, this illustration is such that three sets of the impact crushing mechanism are fitted in place, unlike the case of the above-mentioned illustration, and this category of ground excavating apparatus proves more effective and efficient in the case of conducting crushing of a rock bed. The impact crushing mechanism on the right and the left is fitted in place on the said housing 6 in a proper manner by means of brackets 42, 43, respectively.

Shown in FIG. 6 through FIG. 9 is still other illustration of the present invention. In the drawings, 1 is a fixed member, and this fixed member has a ring-shaped seat 2 for fitting properly formed thereof. The said fitting seat 2 has a pivoted seat 4 properly set in place thereon through a pivoted bearing 3. The said swivel seat 4 has a bracket 5 properly fixed in place thereon. The said bracket 5 has a projection 6*a* of the housing 6 properly fitted in place thereon by means of a pin 7. The said swivel seat 4 has a bracket 8 properly fixed in place thereon, and this bracket 8 has the base end section of a jack 9 for actuating the boom to face upward or downward properly fitted in place thereon by means of a pin 10. The said housing 6 has a bracket 11 properly fitted in place on the front upper section thereof, and the said bracket 11 has a rod 9*a* of the jack 9 properly fitted thereon by means of a pin 12. The said housing 6 has jack supports 36, 37 properly fixed in place on the rear end section thereof, to thus constitute a supporting member A. The said supporting member A has the said guide boom 23 properly fitted in place on the upper section thereof in such a manner as to be capable of sliding, the said guide boom 23 has a bracket 50 for fitting properly fitted in place on the front end section thereof in a manner of being capable of inclining by the employment of a pin 50*a*, the said guide boom 23 further has a supporting bracket 51 properly fixed in place on the right and the left on the front end section thereof, and the said supporting bracket 51 has an inclination jack 52 properly fitted in place thereon in a manner of being capable of rocking. A rod 53 of the said inclination jack 52 is properly fitted in place on the upper section of the said bracket 50 for fitting by means of a pin 54. The said guide boom 23 has a notched hole 55 properly formed in the front upper section thereof. And, the said bracket 50 for fitting has an impact crushing mechanism B properly fitted in place thereon. This impact crushing mechanism B is provided with such an impact-generating mechanism 24 as is fixed in place of the said bracket 50 for fitting, and the said impact-generating mechanism 24 has a chisel 25 properly fitted in place on the movable side thereof.

The said guide boom 23 has a sliding jack 26 properly set in place therein, and the said sliding jack 26 has the jack support 36 properly fitted in place by means of a pin 38. A rod 26*a* of the said sliding jack 26 is properly fitted in place on the said guide boom 23 by means of a pin 39.

Furthermore, the said housing 6 has a bucket boom 13 properly set in place on the lower section thereof in a manner of being capable of sliding, the bucket boom 13 has such bracket as is set on the backside of a bucket 14 properly fitted in place on the front end section thereof by means of a pin 15, the said bucket boom 13 has a supporting bracket 13*a* properly fixed in place on the front end section thereof, the said supporting bracket 13*a* has a bucket jack 16 properly fitted in place thereon by means of a pin 17, and a rod 16*a* of the said bucket jack 16 is properly fitted in place on the said bracket 14*a* set on the back of the bucket 14, by means of a pin 18. The said bucket boom 13 has a sliding jack 20 properly set in place therein, the base end side of the said sliding jack 20 is properly fitted in place on a jack support 37 by means of a pin 40, and a rod 20*a* of the said sliding jack 20 is properly fitted in place on the said bucket boom 13 by means of a pin 41. The said swivel seat 4 is so designed as to be properly swiveled by means of a swivel driving mechanism (not shown in the drawings).

Now, in the case of conducting excavation of a soft and weak stratum, the sliding jacks 20, 20 are actuated, the bucket boom 13 is caused to advance forward, the bucket 14 is caused to draw near to a proposed stratum, the bucket jack 16 is actuated to thus subject the bucket 14 to the motion in the upward and downward directions, and excavation of the stratum is conducted in a proper manner by means of the excavating flukes 50 of the bucket 14.

Meanwhile, in the case of conducting excavation of a hard stratum consisting of a rock bed, the sliding jack 26 is extended for proper actuation, the impact-generating mechanism 24 is caused to advance forward by means of the said guide boom 23, and the chisel 25 is thus properly caused to advance forward.

It is in this state that the said impact-generating mechanism 24 is to be put to proper operation, thus conducting impact-crushing of the proposed stratum.

And, in case a portion of the stratum to be thus subjected to excavation is located undermeath, the inclination jack 52 is actuated, the impact crushing mechanism B is inclined by a proper angle by means of the said bracket 50 for fitting, the angle for excavation is selected in a proper manner, and excavation of the proposed stratum can thus be conducted in an effective and efficient manner. (Reference is invited to FIG. 8 and FIG. 9.)

What is claimed is:

1. A ground excavating apparatus comprising, a fixed member, a supporting member which is fitted in place on said fixed member, a guide boom fitted in place on said supporting member in a manner of being capable of traveling in the forward and rearward directions, means for conducting impact crushing fixed in place on the front end section of said guide boom, and capable of traveling in the forward and rearward directions together with said guide boom, a bucket boom fitted in place on said supporting member on the lower side on said guide boom in a manner of being capable of moving in the forward and rearward directions, a bucket pivotally fitted in place on the top end section of said bucket boom in a manner of being capable of inclining for actuation, primary means of operation set in place on said supporting member, and operates said guide boom in a manner of being actuated so as to move in the forward and rearward directions, secondary means of operation set in place on said supporting member to operate said bucket boom so as to move said bucket in the forward and rearward directions, primary means of inclination operation set in place on said bucket boom for inclining said bucket, and secondary means of inclination operation to make connection between said fixed member and said supporting member, and incline said supporting member.

2. The ground excavating apparatus set forth in the claim 1 above, wherein said impact-crushing means comprises an impact-generating means as is set in place in said guide boom and a chisel as is fitted in place on the front end section of said impact-generating means.

3. The ground excavating apparatus set forth in the claim 1 above, wherein said primary means of operation and said secondary means of operation are a sliding jack, respectively.

4. The ground excavating apparatus set forth in the claim 1 above, wherein said primary means of operation for inclination is a bucket jack, and said secondary means of operation for inclination is a jack for actuating the boom to face upward or downward.

5. The ground excavating apparatus set forth in the claim 1 above, which is further provided with a bracket for fitting as is set in place on said guide boom in a manner of being capable of operating in an inclined state, an impact-crushing means as is fixed in place on said bracket for fitting, and tertiary means of inclination operation as is set in place on said guide boom and operates said impact-crushing means in such a manner as to actuate said impact-crushing means in an inclined state thereof together with said bracket for fitting.

6. The ground excavating apparatus set forth in the claim 1 above, wherein a plurality of said impact-crushing means are fixed in place on said guide boom.

* * * * *